United States Patent [19]

Lindal

[11] 4,103,467

[45] Aug. 1, 1978

[54] COMPRESSABLE PREFABRICATED PANEL SECTIONS FOR WOOD FRAME BUILDINGS

[76] Inventor: Sir Walter Lindal, 1120 Eighth Ave., #1201, Seattle, Wash. 98101

[21] Appl. No.: 723,753

[22] Filed: Sep. 16, 1976

[51] Int. Cl.[2] ..... E04B 1/74

[52] U.S. Cl. ..... 52/404; 52/580; 52/593; 52/809; 206/321

[58] Field of Search ..... 52/574, 79.5, 404, 572, 52/481, 569, 615, 285, 580, 593, 595; 220/321, 322, 507; 206/321

[56] References Cited

U.S. PATENT DOCUMENTS

| | | | |
|---|---|---|---|
| 2,825,674 | 3/1958 | Prase | 52/615 |
| 3,260,027 | 7/1966 | Page | 52/615 |

FOREIGN PATENT DOCUMENTS

| | | | |
|---|---|---|---|
| 589,754 | 6/1947 | United Kingdom | 52/404 |

*Primary Examiner*—John E. Murtagh

[57] ABSTRACT

Wall sections for prefabricated buildings are constructed so that they have one stud and one short bottom plate whose length is equal to the design stud spacing at 90° forming an "L". The sections are covered inside and outside with inside and outside finish. Each section is insulated with fiberglass insulation in batt form. The above description is meant to indicate ordinary building construction. The new sections would be similar except that the stud and plate would be split in two in the plane of and between their covering coats with one part being fixed to the outside finish and the other part being fixed to the inside finish. The fiberglass insulation would not be cut and would be left adhered to the inside surface. For shipping purposes and to cut bulk, one section half would be spun around 180° and offset so that the two "L" shaped framing members would form a rectangle and then it would be crushed against the other half section, compressing the resilient fiberglass insulation to less than a small fraction of the wall thickness and fastened tight in this manner for shipment. After shipment, the half sections are set in their proper relation allowing the insulation to expand fully and the sections are fixed into the building.

4 Claims, 19 Drawing Figures

COMPRESSABLE PREFABRICATED PANEL SECTIONS FOR WOOD FRAME BUILDINGS

FIELD OF INVENTION

This invention relates to an improvement in prefabricated frame building wall section design which enables reduction of bulk for shipping purposes, using standard accepted building materials.

SUMMARY OF INVENTION

With the advent of fuel shortages and their increased costs, the public and public authorities are demanding much more insulation in buildings to conserve our resources and to lower heating costs. This has led to doubling the amount of insulation used. The extra insulation is not very expensive and the job builders are quickly conforming to demand and law. However, the home manufacturer or prefabber has another problem; his new sections are more bulky for shipping purposes. The freight on prefab building sections is governed by bulk, not weight, and even where local truck delivery is used, the new house often needs a second truck and driver where it would formerly be delivered in one load. Some have reduced bulk by using plastic foam insulation such as Urathane. This is better insulation, but is twice the cost of fiberglass and also it has been legislated against as it produces toxic gases if overheated. My design improvement is to reduce bulk by making a section that can be compressed before shipment to half its final thickness. Fiberglass is the lowest cost insulation and it can be compressed to a fraction of its finished thickness and will recover its design thickness as soon as the compression is released. This design envisions a section whose width is the dimension between two studs and whose length would be a single story wall height. An expected wall section size might be two feet by eight feet.

BRIEF DESCRIPTION OF THE DRAWINGS

In summary,

In more detail, FIG. 2 is a bottom view of a normal wall section.

FIG. 1 is a side view and FIG. 3 is an inside view of a normal wall section. FIG. 4 is a vertical section and FIG. 5 is a horizontal cross section. FIG. 6 is an end view of a similar section that has been split in half. FIG. 7 is a side view, FIG. 8 is a vertical section and FIG. 9 is a horizontal cross section of a split section. FIG. 10 is an end view of a section packaged for shipping, FIG. 12 is a side view, FIG. 11 is a vertical section and FIG. 12A is a horizontal section of the packaged section. FIG. 13 is an inside face view of a section prepared for wrapping for shipment. FIG. 14 is a vertical end view of the wall section, showing it reassembled and nailed into place in a building. FIG. 15 is a bottom view of the same section and FIG. 16 is a cross section; both show the wall section reassembled and set in between other similar sections in a building; 15A and 16A show lap and bevel joint options.

DESCRIPTION OF THE PREFERRED EMBODIMENTS

Figure 2:
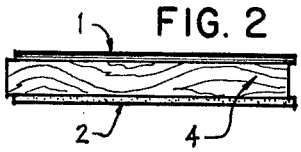
FIGS. 1 to 5 show views and cross sections of a normal wall section construction, but limited in width to the distance between studs with normal wall height.
Figure 6:
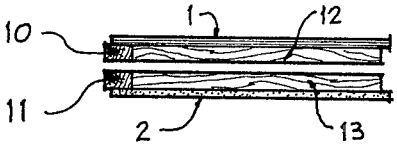
FIGS. 6 to 9 show the section split in half across a plane parallel to its faces, except that all the insulation is left adhered to the inside side.
Figure 1:
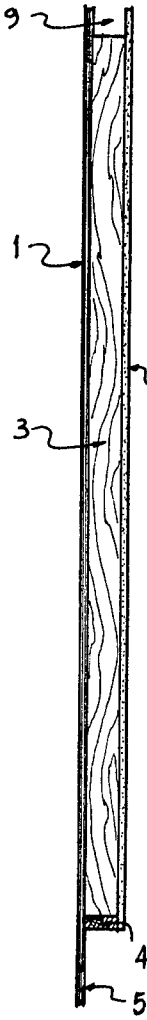
Figure 3:
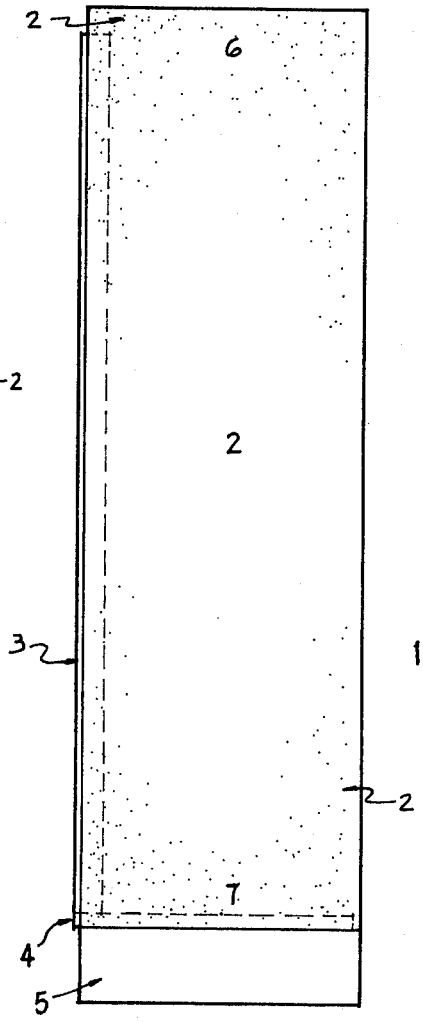
Figure 4:
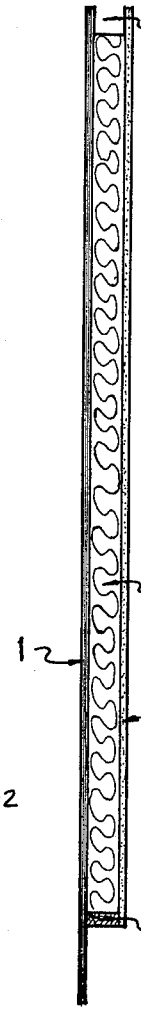
Figure 7:
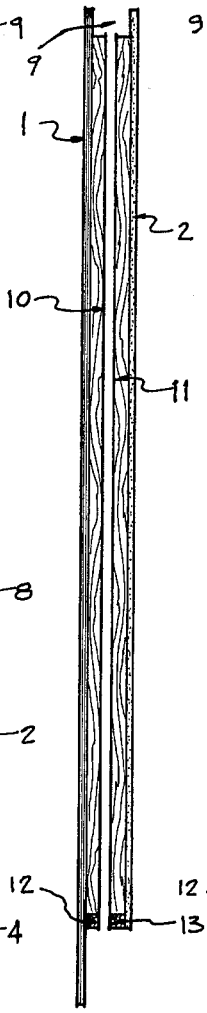
Figure 8:
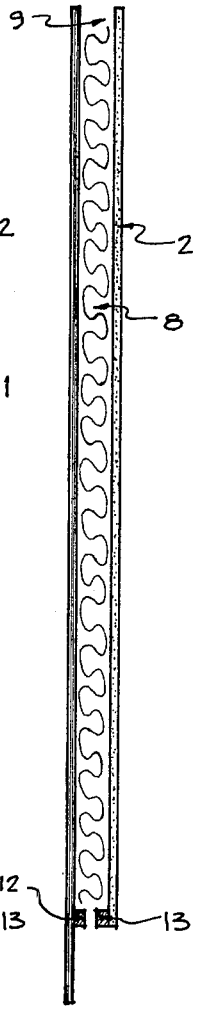
Figure 5:
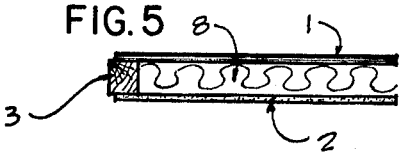
Figure 9:
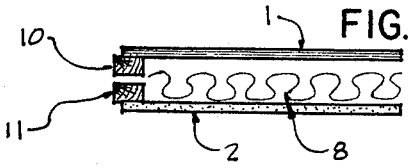
Figure 10:
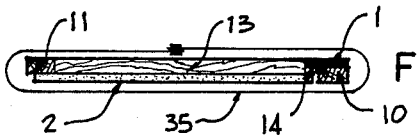
FIGS. 10 to 13 show how the inside half of the section has been spun around 180° and slightly offset and compressed together forming a package half the thickness of the usual section, which is cardboard wrapped and steel banded together.
Figure 11:
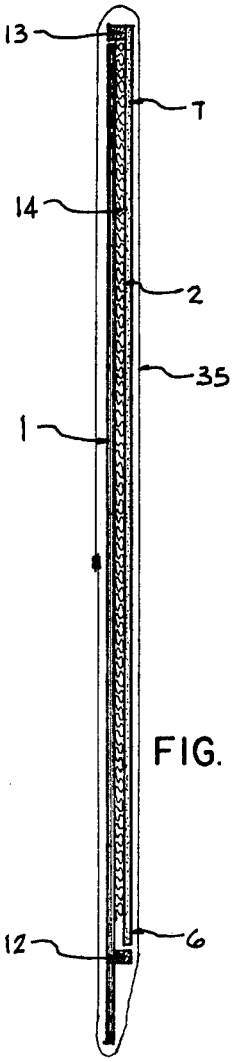
Figure 12:
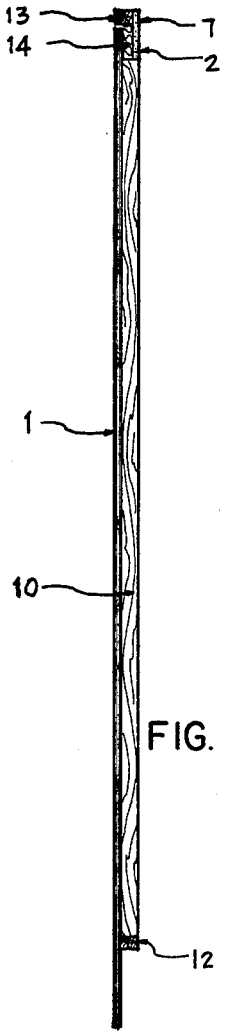
Figure 13:
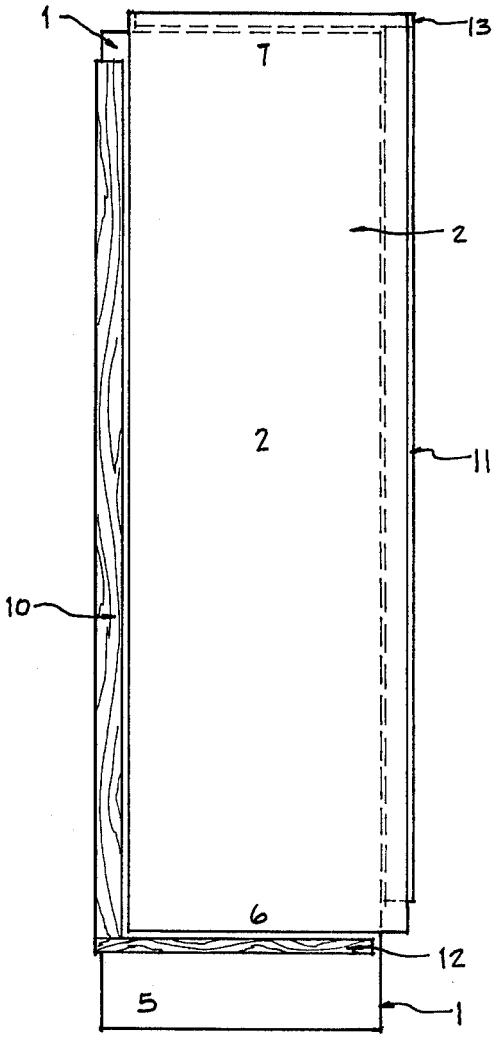
Figure 12A:
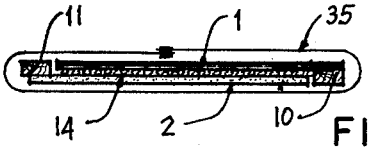

FIGS. 1 to 5 show a typical wall section having outside siding 1, inside panelling or other finish 2, one stud 3, one plate 4, and insulation 8. Five indicates the bottom part of the outside siding, 6 indicates the top of the inside finish and 7 indicates the bottom of the inside finish.

FIGS. 6 to 9 illustrate how the typical wall section may be cut in half on the plane of its inside and outside finish. The stud 3 becomes the half 10 attached to the outside siding and the half 11 attached to the inside finish. Similarly, the plate 4 becomes the half plate 12 on the outside half and the half plate 13 on the inside half. The insulation is left adhered to the inside surface.

FIGS. 10 to 13 illustrate how the halfed sections can be packaged and banded together for shipping purposes in a package that has 50% of the thickness of the regular wall section. This is accomplished by spinning one half (the inside half) 180° in its plane and moving it slightly upwards so the half plate on the inside panel goes over the edge of the outside panel, and also moving it slightly sideways so that the half stud on the inside half section goes to the side of the outside siding panel. This allows the inside panel 2 to be free to squeeze the insulation against the outside siding panel 1. The insulation 8 is now shown as compressed insulation 14, and it can be noted that the bottom of the inside panel 7 and the top 6 have changed positions. The compressed section may be wrapped in cardboard 35 to protect it and banded with steel strapping to keep the insulation crushed and the package a minimum thickness. Fiberglass insulation is used, which is very springy and will, if not held down, separate the two section halfs.

Figure 14:
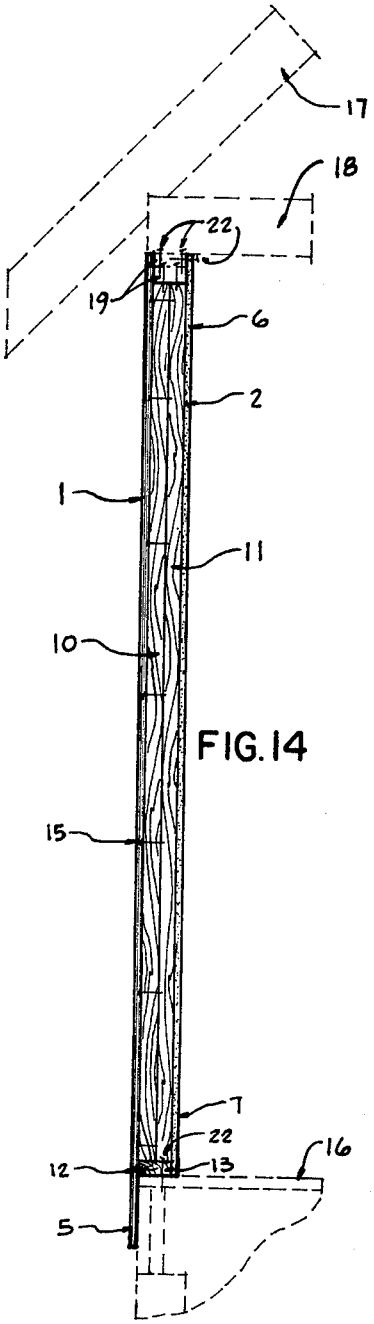
FIGS. 14 and 16 show the wall section reconstructed to its planned thickness and nailed together and nailed into a building.
Figure 15A:
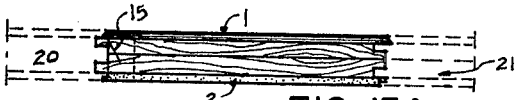
Figure 15:
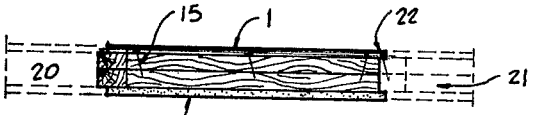
Figure 16A:
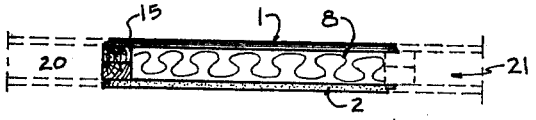
Figure 16:
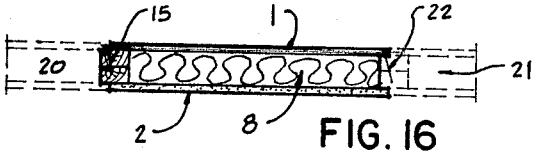

FIGS. 14 to 16 illustrate the two half wall sections unpacked and nailed together using nails 15, to the same configuration as a usual wall and the assembled wall is shown attached to building floor system 16, and to adjoining similar wall sections 20 and 21. A series of similar sections can be attached together using the usual double top plate system 19. The sections are nailed together and to the floor and to the 2 top plates using nails 22. A ceiling assembly 18 and a roof assembly 17 are shown built onto the top of the wall section.

What I claim my invention is:

1. A prefabricated wood frame wall section for a building wall containing outside siding, inside panelling, insulation and stud and plate framing; the height of the section being the desired building wall height; the thickness of the section being the thickness of the panelling, plus the larger dimension of the framing, plus the thickness of the outside siding, said stud and plate frame consisting of a split vertical stud and split horizontal bottom plate, split lengthwise in the same plane as the section surfaces so that the section is effectively divided in half, with the division of said framing members varying with the relative comparative thickness of the inside panelling and outside siding that is used; said insulation being left uncut and affixed to the internal surface of the inside panelling, the split stud and plate framing parts being fixed to the inside panelling and outside siding section halfs so as to form an "L" with the stud part on the inside panelling half section edge opposing the stud part on the outside siding half section edge and the opposing plate parts being on the bottom of the section, the said split stud parts being attached to their respective half sections so that a small fraction of their edge is exposed malelike to receive the opposite section edge of a similar connecting section and the split bottom plate having the "toe" of the "L" the same fraction short of extending to its section edge to allow the insertion of the male part of another similar section's stud; wherein one half of the divided section has been rotated 180° in its plane causing the "L" framing to form a rectangle and with the framing members of each half overlapping the edges of the opposing panel forming a compressible box in which the insulation has been crushed; said half panels being compressed together and fixed together by packaging and banding into a package approximately half the thickness of the section.

2. A prefabricated wood frame wall section made as in claim 1, where the two halfs are nailed together and built into a building.

3. Prefabricated building sections made up as in claim 1, where the insulation used is specifically spun fiberglass wool and capable of full recovery in size after being compressed to a quarter of its thickness.

4. Prefabricated bulding sections made up as in claim 1, where the panel finish inside and out is shiplapped.

* * * * *